US006384901B1

(12) United States Patent
Johnson

(10) Patent No.: US 6,384,901 B1
(45) Date of Patent: May 7, 2002

(54) SHEET MEDIA SKEW ADJUSTMENT IN A PRINTER OUTPUT

(75) Inventor: Steven M. Johnson, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/489,296

(22) Filed: Jan. 21, 2000

(51) Int. Cl.[7] ..... G03B 27/00; G03B 27/52; B65H 7/02

(52) U.S. Cl. ..... 355/407; 355/40; 271/228

(58) Field of Search ..... 355/27–29, 40, 355/4, 407–408; 399/404; 271/250–253, 226–228, 274

(56) References Cited

U.S. PATENT DOCUMENTS

| | | | | |
|---|---|---|---|---|
| 4,981,293 A | | 1/1991 | Yamashita et al. | 271/184 |
| 4,989,853 A | | 2/1991 | Matysek et al. | 270/58 |
| 5,007,625 A | | 4/1991 | Kremers et al. | 270/53 |
| 5,273,274 A | * | 12/1993 | Thompson et al. | 271/228 |
| 5,278,624 A | * | 1/1994 | Kamprath et al. | 355/317 |
| 5,499,811 A | * | 3/1996 | Hayashi et al. | 271/293 |
| 6,019,365 A | * | 2/2000 | Matsumura | 271/227 |
| 6,273,418 B1 | * | 8/2001 | Fujikura et al. | 271/228 |

FOREIGN PATENT DOCUMENTS

| | | |
|---|---|---|
| GB | 1256289 | 8/1969 |
| GB | 1295388 | 8/1971 |

* cited by examiner

*Primary Examiner*—Russell Adams
*Assistant Examiner*—Hung Henry Nguyen

(57) ABSTRACT

Sheet media alignment and offsetting devices and methods in which all sheets output by the printer are more reliably moved to the correct output position. In one embodiment, each sheet is moved to an "aligned" position as it is conveyed through the alignment/offset mechanism and then, if offsetting is desired, the sheet is moved the desired offset distance from the aligned position to the correct offset position. Preferably, the aligned position is set to correspond to the correct non-offset output position so that each sheet is output to the correct position whether or not offsetting is used. In an alternative embodiment, each sheet is moved directly from the position it is received in the output device to either the aligned position for non-offset output or to the offset position for offset output.

3 Claims, 6 Drawing Sheets

SHEET MEDIA SKEW ADJUSTMENT IN A PRINTER OUTPUT

FIELD OF THE INVENTION

The invention relates generally to printers, copiers and other image forming devices and, more particularly, to a sheet media alignment and offsetting system in which all sheets output by the printer are more reliably moved to the correct output position.

BACKGROUND

In many conventional printers and copiers, the paper or other sheet media is conveyed by rollers from the print engine to the output tray, sorter stacking trays or some other output device. (For convenience, printers, copiers and other image forming devices will be referred jointly as printers unless noted otherwise.) Some printers include an offsetting feature in which one document is offset from the prior document output to the same tray. If a user selects a printer's offsetting feature, each sheet in a second document or print job is output to the output tray off set a predetermined distance to one side, usually about ½, from the sheets in the previously output document or print job. Offsetting is used to separate multiple documents or print jobs output to the same tray.

For center justified printers in which an output side guide is not available for all paper sizes, position errors perpendicular to the transport direction can occur as paper is conveyed to the output device. This misalignment is sometimes referred to as "skew" and misaligned sheets are said to be "skewed." Conventional offset devices assume a nominal center position for each sheet output from the print engine. Each sheet is moved right or left a predetermined distance from this position without regard to the actual position of the sheet. If a sheet is misaligned to this nominal position, then the alignment error is carried forward affecting the final sheet position. Hence, proper alignment is important to the offsetting feature to ensure that all sheets in a print job are output in an orderly stack and to ensure that the stack of sheets in each print job is properly offset from other print jobs output to the same tray.

SUMMARY

The present invention is directed to sheet media alignment and offsetting devices and methods in which all sheets output by the printer are more reliably moved to the correct output position. In one embodiment, each sheet is moved to an "aligned" position as it is conveyed through the alignment/offset mechanism and then, if offsetting is desired, the sheet is moved the desired offset distance from the aligned position to the correct offset position. Preferably, the aligned position is set to correspond to the correct non-offset output position so that each sheet is output to the correct position whether or not offsetting is used. In an alternative embodiment, each sheet is moved directly from the position it is received in the output device to either the aligned position for non-offset output or to the offset position for offset outputs

DESCRIPTION

Although several embodiments of the invention will be described with reference to the printer and paper trays shown in FIG. 1, the invention is not limited to printers and paper trays. The invention may be implemented in or used with any type of image forming machine and with any type of output tray or device that includes a sheet offsetting feature or in which it is otherwise desirable to align the output sheets. Accordingly, it is to be understood that the following description and the drawings illustrate only a few exemplary embodiments of the invention and its implementation. Other embodiments, forms and details may be made without departing from the spirit and scope of the invention, which is expressed in the claims that follow this description.

Figure 1:
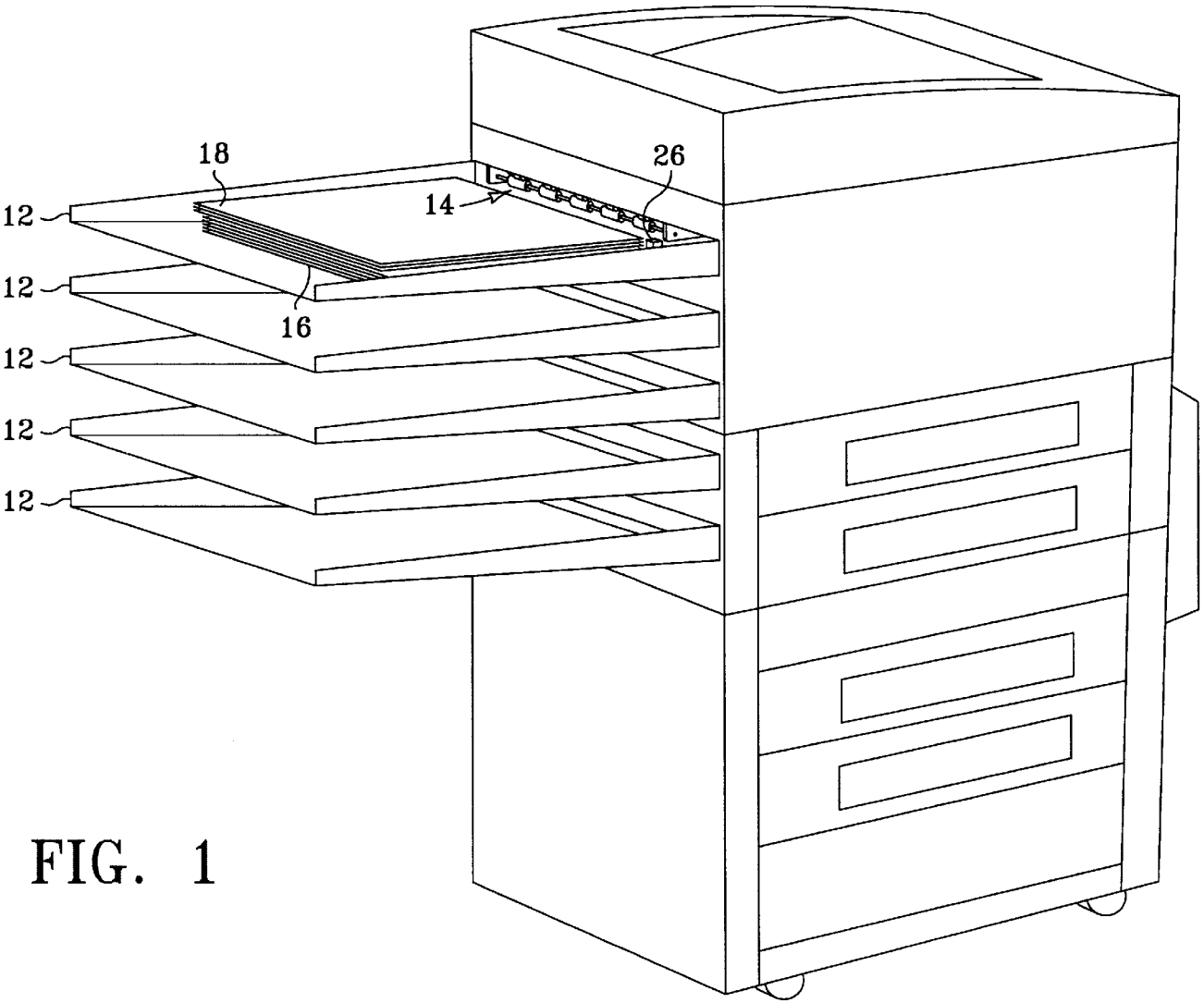
FIG. 1 is an isometric view of a printer with an offset mechanism constructed according to one embodiment of the invention in which an alignment sensor is used to properly align each sheet output by the printer.

Referring to FIG. 1, paper or other sheet media is output from printer 10 to trays 12. An offset mechanism 14 outputs the paper to one or more trays 12 and implements the offset feature available with printer 10. Offset mechanism 14 may be any conventional offset mechanism modified according to the present invention as described below. FIG. 1 shows a first stack of papers 16 representing a first print job or document and a second stack of papers 18 representing a second print job or document. The second stack 18 is offset from the first stack 16 so the user can readily distinguish between the two print jobs.

Figure 2:
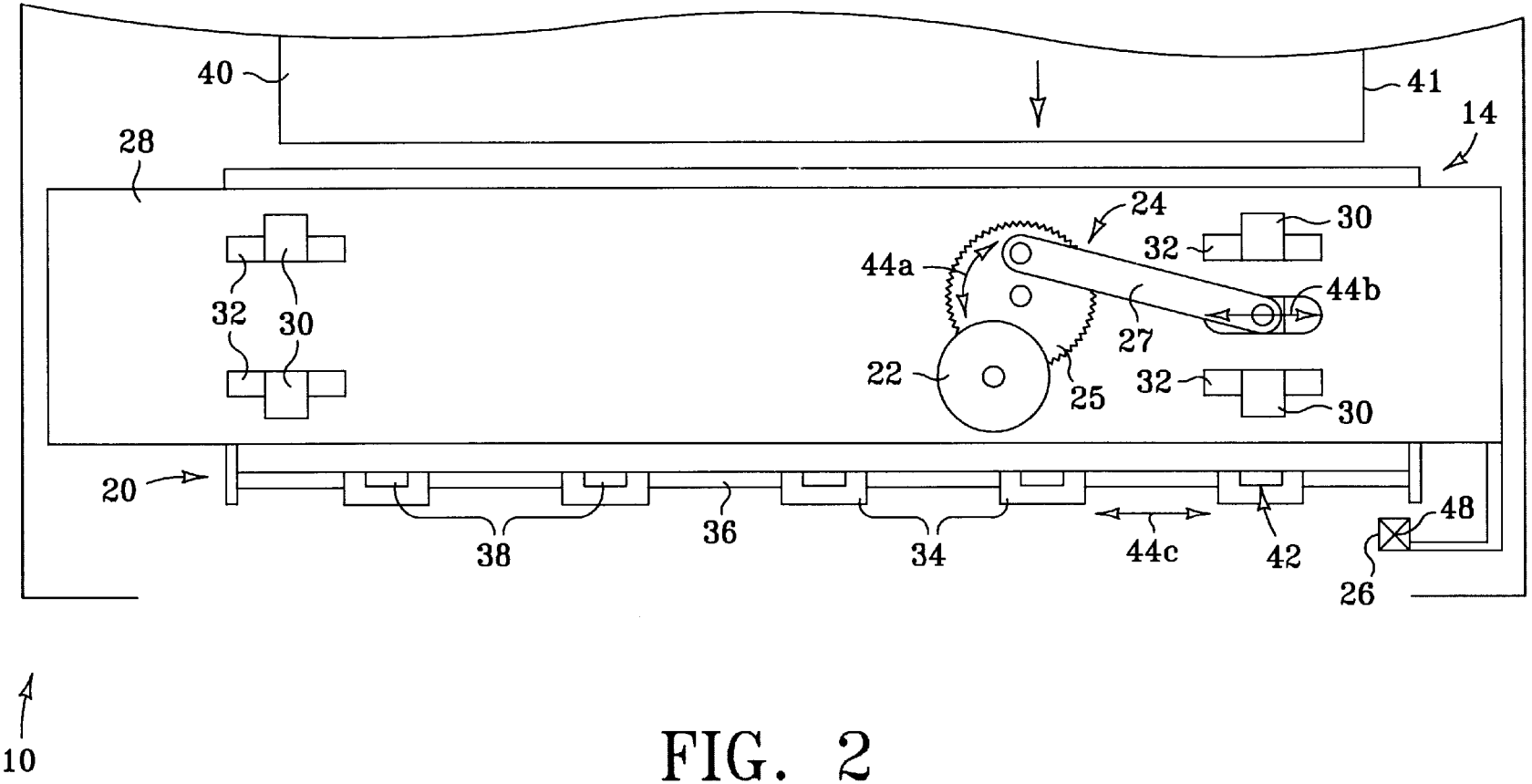
FIG. 2 is a plan view of the offset mechanism of FIG. 1.

Referring now also to FIG. 2, offset mechanism 14 includes a movable carriage 20, offset motor 22 operatively coupled to carriage 20 through a drive train 24 (in this case, gear 25 and connecting rod 27), and a sensor 26. Offset motor 22 and carriage 20 are mounted to a support 28 positioned above the carriage. Carriage 20 is mounted to support 28 through a pair of flanges 30 that extend through slots 32 in support 28. Carriage 20 includes offset rollers 34 on shaft 36, a drive motor (not shown) and idler rollers 38. The drive motor rotates shaft 36 to turn offset rollers 34. In operation, as each sheet 40 of paper or other print media clears the final set of rollers in the print engine of printer 10, it is caught in the nip 42 between driven rollers 34 and idler rollers 38 in offset mechanism 14 and conveyed through carriage 20 into an output tray 12. Offset motor 22 moves carriage 20 back and forth as indicated by arrows 44*a,* 44*b* and 44*c* to receive and offset sheets 40.

Except for sensor 26, the offset mechanism described above is a conventional offset mechanism representative in its construction and operation of the various types of offset mechanisms currently used with image forming devices. Conventional offset mechanisms assume a nominal center position for each sheet output from the print engine. Each sheet is offset a predetermined distance from the assumed position without regard to the actual position of the sheet. If a sheet is misaligned to this nominal position, then it will not be offset to the correct position. In the present invention, sensor 26 is used along with appropriate control circuitry and logic in the printer or output device controller to compensate for the effects of misalignment.

Figure 3:
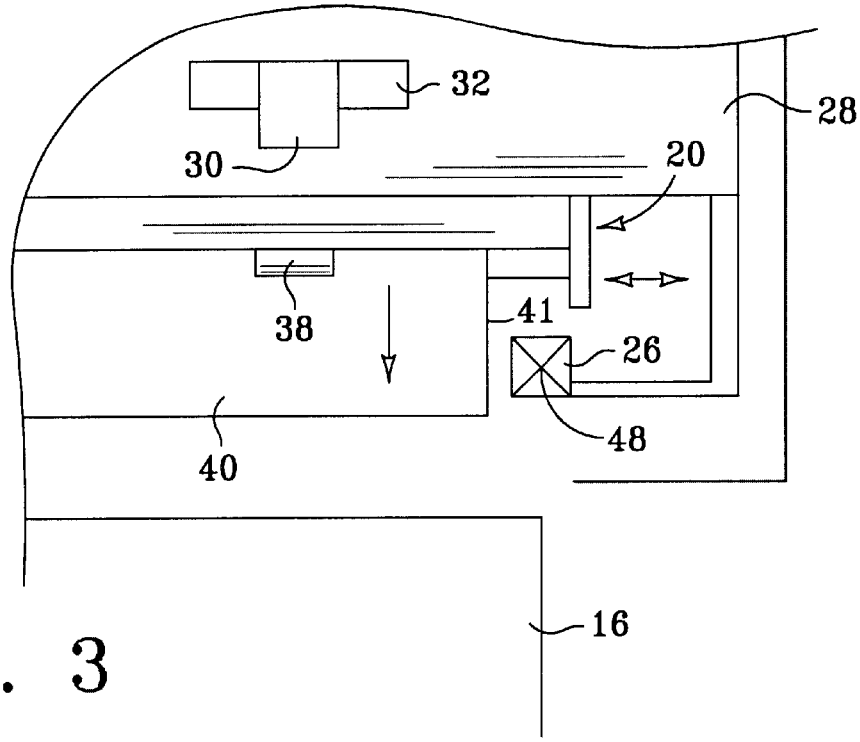
FIGS. 3 and 4 are partial plan views of the offset mechanism of FIG. 1 showing in sequence the alignment and output of a sheet of paper or other print media.
Figure 4:
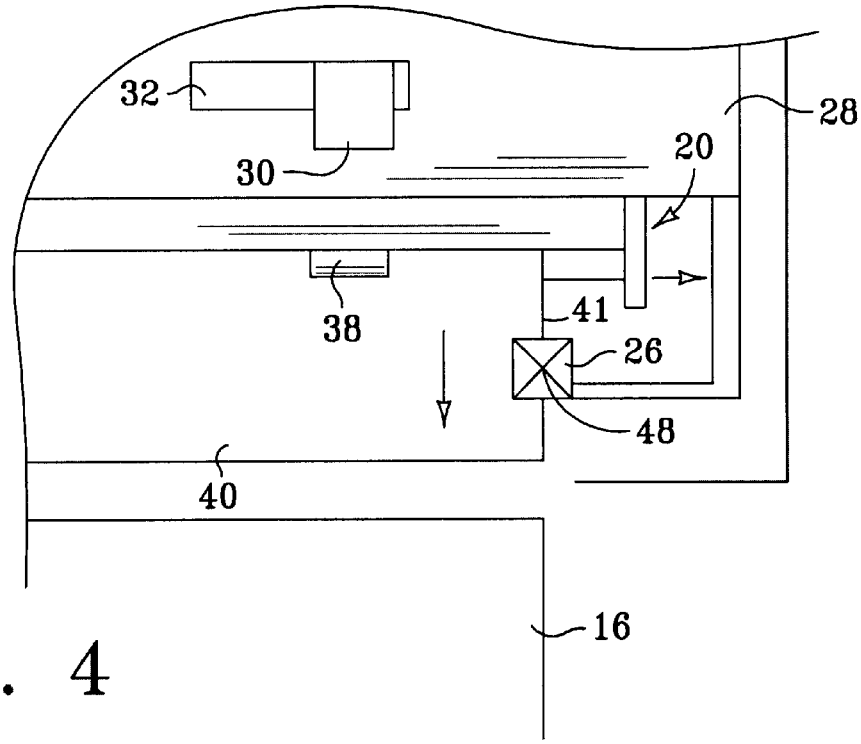

Referring now to FIGS. 2, 3 and 4, sensor 26 is positioned at one end of carriage 20 at the approximate location of an outside edge 41 of sheet 40. Sensor 26 is stationary relative to carriage 20. It is expected that, in most operating environments, sensor 26 will be positioned at the location of the proper non-offset output edge alignment for sheet 40 and that this aligned position will be established just outside the maximum possible misalignment so that the edge of sheet 40 will always fall outside the sensor's detection zone when sheet 40 enters offset mechanism 14. Then, as each sheet 40 enters offset mechanism 14, carriage 20 is moved toward the outside (left or right depending on which end sensor 26 is mounted) until sensor 26 senses the edge 41 of sheet 40. Other configurations, however, may be used depending on the type of sensor, control circuitry and logic necessary or desirable for a particular system.

Although any device that senses or detects the edge 41 of sheet 40 at the desired position may be used as sensor 26, it is expected that some type of photo sensor will be preferred for most applications. A typical photo sensor includes a light emitting diode (LED) and a photo transistor. A tungsten lamp, a neon lamp or any suitable source of light radiation, usually infrared light, may be used as an alternative to the LED. Similarly, a photo diode, photo resistor or any other suitable sensor of light may be used as an alternative to the photo transistor. The LED and photo transistor are mounted opposite one another across the plane of sheet 40 to form a zone in which sheet 40 may be detected. The light beam passes through the detection zone at the center of the X marked on sensor 26 in FIGS. 2–9. As always, X marks the spot. The output signal from the photo transistor indicates the presence or absence of sheet 40 in the detection zone. Other suitable sensing devices include an edge sensor that is tripped when edge 41 of sheet 40 contacts the sensor as the sheet is moved to the aligned position.

FIGS. 3 and 4 show the alignment of sheet 40 for output to the desired position on tray 12. In FIG. 3, sheet 40 enters offset mechanism 14 at a nominal center position. At the urging of offset motor 22, carriage 20 is moved to the right until sensor 26 indicates the presence of sheet 40 in the sensor's detection zone 48, as shown in FIG. 4. Sheet 40, which is then properly aligned, is output to tray 12. Carriage 20 is returned to the nominal center starting position shown in FIG. 2 to receive the next sheet. To output a properly aligned sheet as quickly as possible, sheet 40 is, preferably, conveyed forward at the urging of offset rollers 34 continuously throughout the alignment process as can be seen by comparing the position of sheet 40 in FIGS. 3 and 4.

Figure 5:
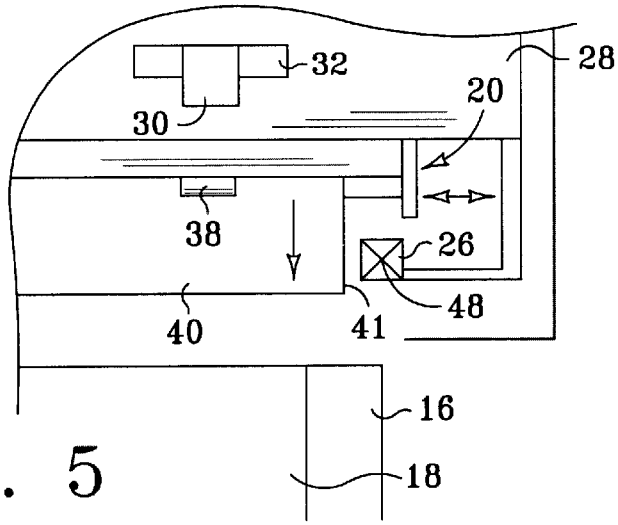
FIGS. 5–7 are partial plan views of the offset mechanism of FIG. 1 showing in sequence the alignment, offset and output of a sheet of paper or other print media.
Figure 6:
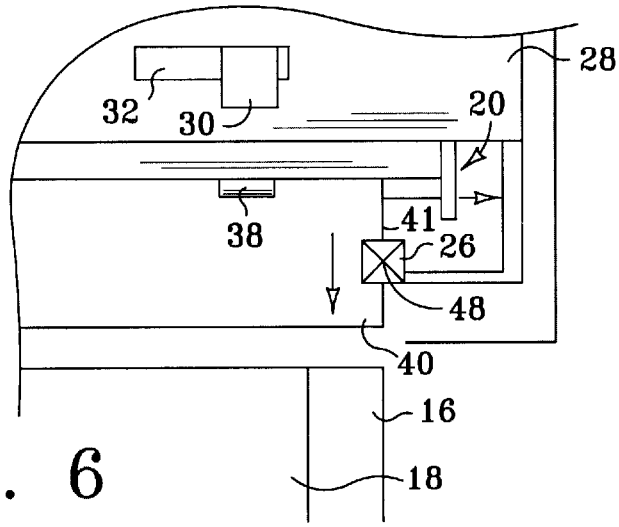
Figure 7:
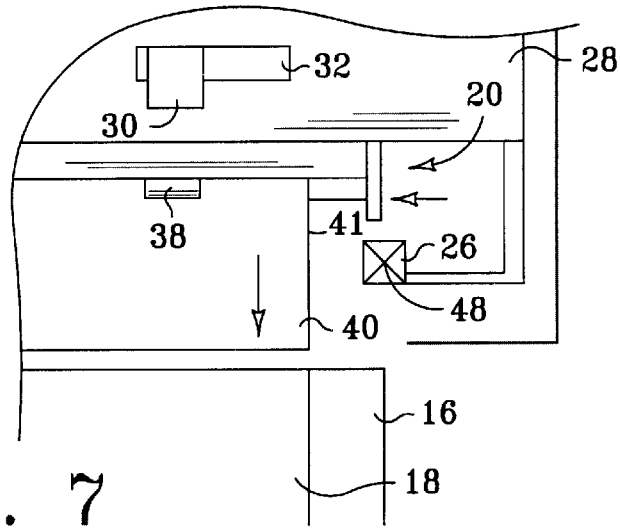

The alignment and offset of sheets 40 is shown in FIGS. 5–7. Referring to FIGS. 5–7, a first stack of sheets 16 has been output to tray 12 in the non-offset position and a second stack of sheets 18 is being output to tray 12 in an offset position. In FIG. 5, sheet 40 enters offset mechanism 14 at a nominal center position. In FIG. 6, carriage 20 is moved to the right until sheet 40 is aligned as described above. Then, at the further urging of offset motor 22, carriage 20 is moved back to the left a predetermined offset distance, typically about 13 mm, as shown in FIG. 7. Sheet 40, which is then offset the desired distance, is output to tray 12. Sheet 40 is, preferably, conveyed forward at the urging of offset rollers 34 continuously throughout the alignment and offsetting process as can be seen by comparing the position of sheet 40 in FIGS. 5, 6 and 7.

Figure 8:
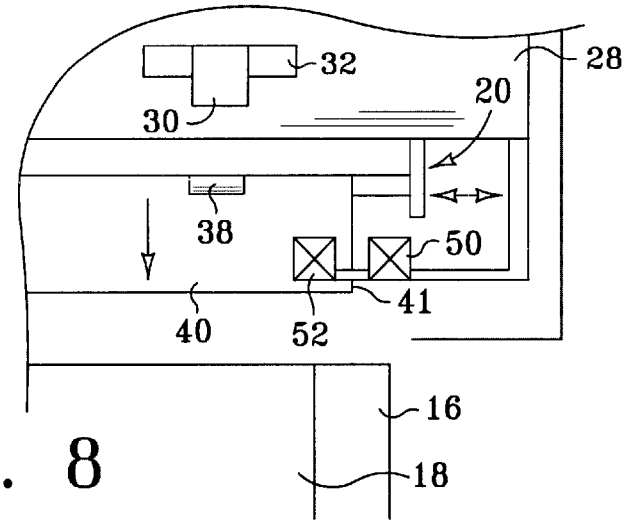
FIGS. 8–10 show an alternative embodiment of the invention in which each sheet is output to the desired aligned and offset positions using dual sensors that sense the sheet at both positions.
Figure 9:
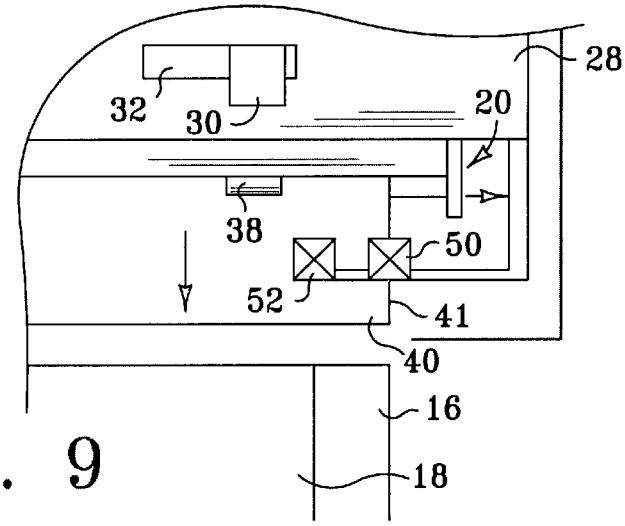
Figure 10:
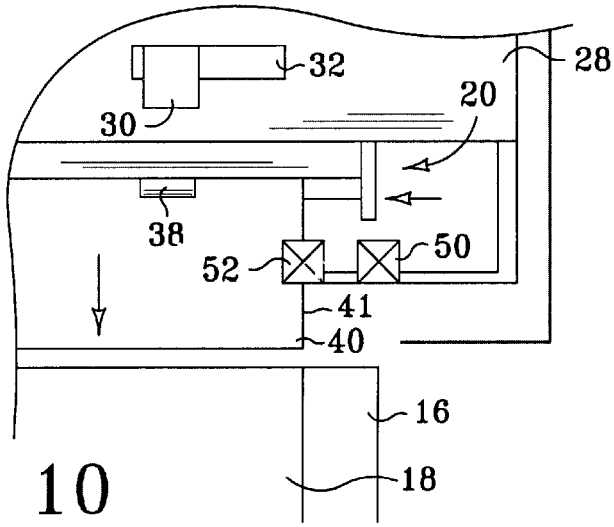

FIGS. 8–10 show an alternative embodiment of the invention in which each sheet 40 is output to the desired aligned and offset positions by sensing sheet 40 at both positions. In this embodiment, an alignment sensor 50 like sensor 26 in the prior embodiment is positioned at one end of carriage 20, preferably, just outside the maximum possible misalignment of sheet 40 so that edge 41 of sheet 40 will always fall outside the sensor's detection zone when sheet 40 enters offset mechanism 14. An offset sensor 52 is positioned at desired offset. In FIG. 8, sheet 40 enters offset mechanism 14 at a nominal center position. For sheets that will be output to the aligned position, as shown in FIG. 9, carriage 20 is moved to the right until alignment sensor 50 indicates the presence of sheet 40. Sheet 40 is then output to tray 12 in the aligned position. For sheets that will be output to the offset position, as shown in FIG. 10, carriage 20 is moved to the left until offset sensor 52 indicates the presence of sheet 40. Sheet 40, which is then properly offset, is output to tray 12.

Using the dual sensor configuration of the embodiment of FIGS. 8–10 eliminates the need to align each sheet before offsetting the sheet. If the offset feature is selected on the printer or output device, carriage 20 is moved immediately left to the offset position without first aligning the sheet to outside alignment sensor 50. If the offset feature is not selected, carriage 20 is immediately moved to the right to the aligned position at outside sensor 50. As with the first embodiment, carriage 20 is returned to its nominal center position to receive the next sheet.

Figure 11:
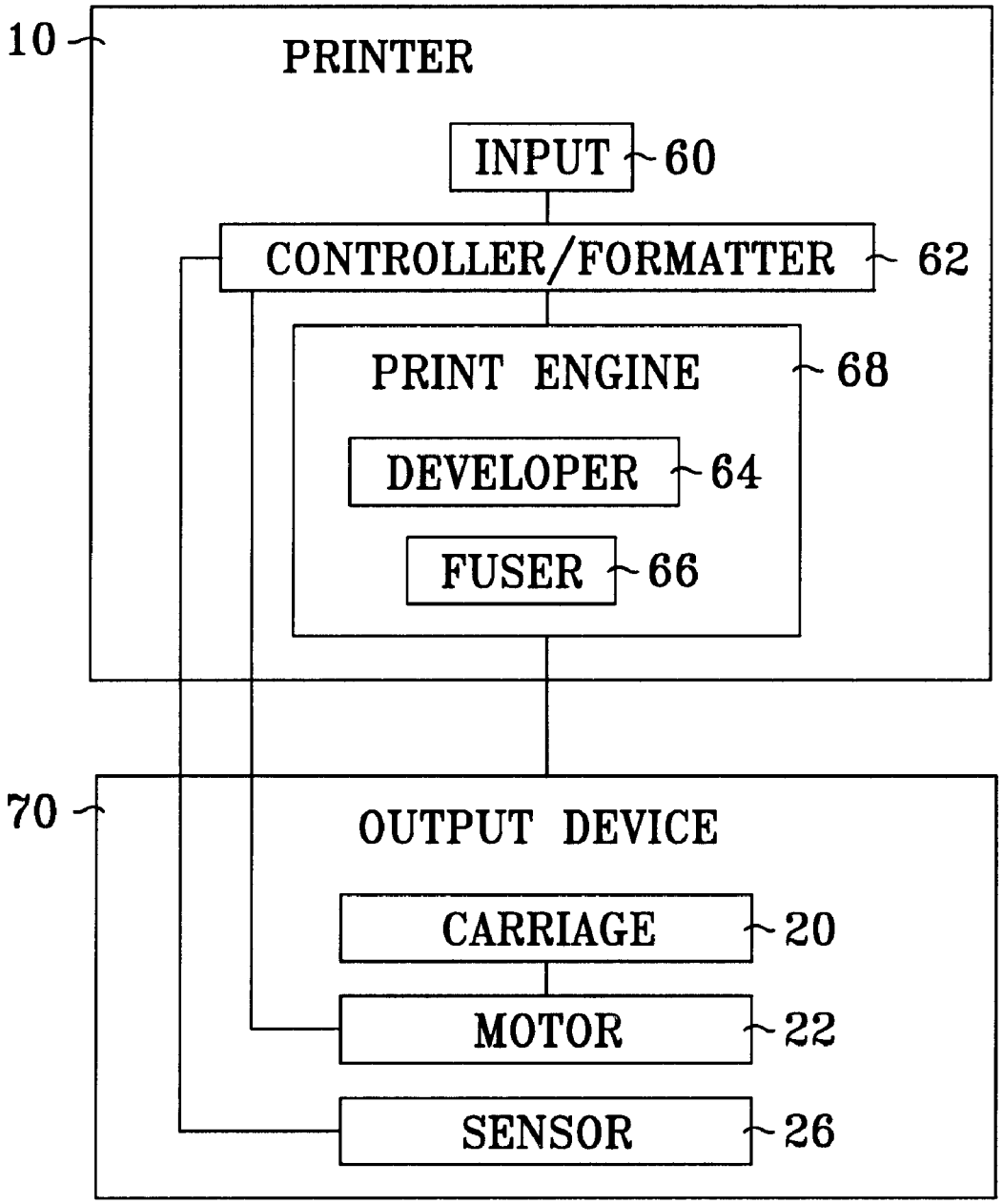
FIG. 11 is a block diagram of an image forming device implementing one embodiment of the invention.

FIG. 11 is a block diagram of an image forming device, a laser printer in this example, implementing one embodiment of the invention. Referring to FIG. 11, data representing the desired print image is transmitted to input 60 on printer 10 from, for example, a scanner or document generating software on a client computer. The data is analyzed in the printer's controller/formatter 62. Controller 62 typically consists of a microprocessor and related programmable memory and page buffer. Controller 62 formulates and stores an electronic representation of each page that is to be printed. In addition to formatting the data received through input 60, controller 62 drives and controls the toner development unit 64, fuser 66 and other components of print engine 68. Once a sheet is printed and fused, the sheet passes from print engine 68 to an output device 70. Output device 70 represents generally any device for delivering printed sheets to the user. For example, output device 70 could be a movable carriage assembly integral to printer 10, a discrete binding and finishing device with its own control logic and circuitry or an offset mechanism such as that described above. In this example, output device 70 represents offset mechanism 14 which includes a sensor 26 electronically coupled to printer controller 62. If output device 70 includes its own control logic and circuitry, then sensor 26 is also coupled to the output device controller. The output signals from sensor 26 (or sensors 50 and 52 if dual sensors are used) indicating the presence of absence of sheet 40 are transmitted to printer controller 62 or, if a discrete output device is used, then to the output device controller. The output from sensor 26 is utilized by controller 62 to control motor 22 and, correspondingly, the movement of carriage 20 as described above.

What is claimed is:

1. An offset mechanism for an image forming machine, comprising:

a movable carriage having driven rollers for conveying media sheets through the carriage in a first direction;

a motor operatively coupled to the carriage for moving the carriage laterally in a second direction perpendicular to the first direction;

first and second sensors disposed near the carriage, the sensors configured to detect the presence of a media sheet at the location of each sensor; and wherein the carriage is movable laterally at the urging of the motor from a receiving position at which a sheet is received by the carriage to an aligned position at which the sheet is detected by the first sensor, and from the receiving position to an offset position at which the sheet is detected by the second sensor at a predetermined offset distance from the aligned position.

2. The mechanism of claim 1, wherein the carriage is also movable from the aligned position to the receiving position and from the offset position to the receiving position.

3. An image forming reaching, comprising:

an input for receiving print data;

a print engine;

an output device operatively coupled to the print engine;

a controller electronically coupled to the input, the print engine and the output device, the controller configured to format the print data and control the print engine and the output device; and wherein the output device comprises:

a movable carriage having driver rollers for conveying media sheets through the carriage in a first direction;

a motor operatively coupled to the carriage for moving the carriage laterally in a second direction perpendicular to the first direction;

first and second sensors disposed near the carriage, the sensors configured to detect the presence of a media sheet at the location of each sensor; and wherein the carriage Is movable laterally the urging of the motor from a receiving position at which a sheet is received by the carriage to an aligned position at which the sheet is detected by the first sensor, and from the receiving position to an offset position at which the sheet is detected by the second sensor at a predetermined offset distance from the aligned position.

* * * * *